United States Patent [19]

Murphy

[11] 4,084,658

[45] Apr. 18, 1978

[54] TUNABLE EXPANSION CHAMBER FOR INTERNAL COMBUSTION ENGINES

[75] Inventor: Milo E. Murphy, Long Beach, Calif.

[73] Assignee: Custom-Bilt, Seal Beach, Calif.

[21] Appl. No.: 739,196

[22] Filed: Nov. 5, 1976

[51] Int. Cl.[2] ..... F01N 1/00

[52] U.S. Cl. ..... 181/241; 181/279; 181/281

[58] Field of Search ..... 181/226, 241, 264, 279, 181/280, 281

[56] References Cited

U.S. PATENT DOCUMENTS

| | | | |
|---|---|---|---|
| 1,631,391 | 6/1927 | Williams | 181/281 |
| 2,112,006 | 3/1938 | Abramson | 181/279 |

*Primary Examiner*—Robert C. Watson

*Attorney, Agent, or Firm*—Wm. Jacquet Gribble

[57] ABSTRACT

A two-piece outer casing encloses a volume with a central divider plate which extends the length of the casing. The two portions of the casing are bolted or otherwise clamped about the divider plate. Each half of the outer casing has angled inner ribs or diverters. The diverters in one casing extend at an opposite angle to the longitudinal axis of the central plate as do the diverters of the other outer casing. The inner edges of the diverter seal against the surface of the central plate. The transverse dimension of the central plate is less than the transverse dimension of the diverters and the outer casing such that an exchange aperture is defined between the central plate and the inner surface of the outer casing between adjacent pairs of diverters. The casing has an exhaust input port and an exhaust outlet port at opposite ends and opposite sides. The plate and the diverters and the casing walls define a continuous twisting passage from inlet port to outlet port, the length of which is calculated to "tune" the expansion chamber to the particular engine with which it is to be used.

The central divider plate may be varied in width to change the effective length of the continuous passage to further tune the expansion chamber to the engine. Outer fins on the casing provide for heat dissipation.

13 Claims, 8 Drawing Figures

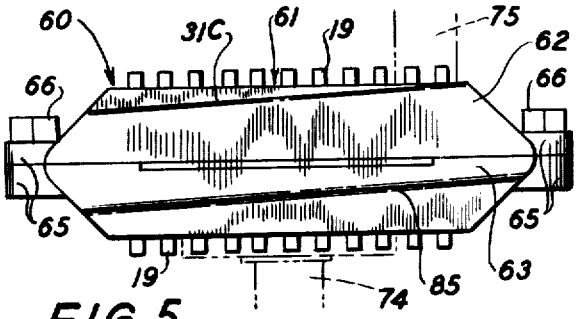
FIG. 5.
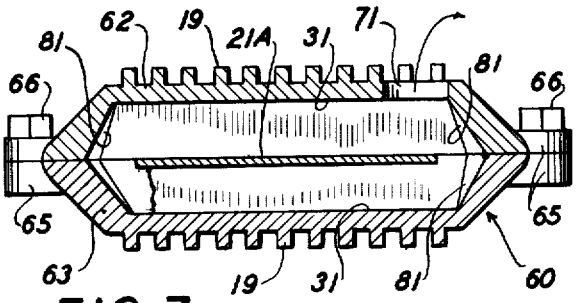
FIG. 7.
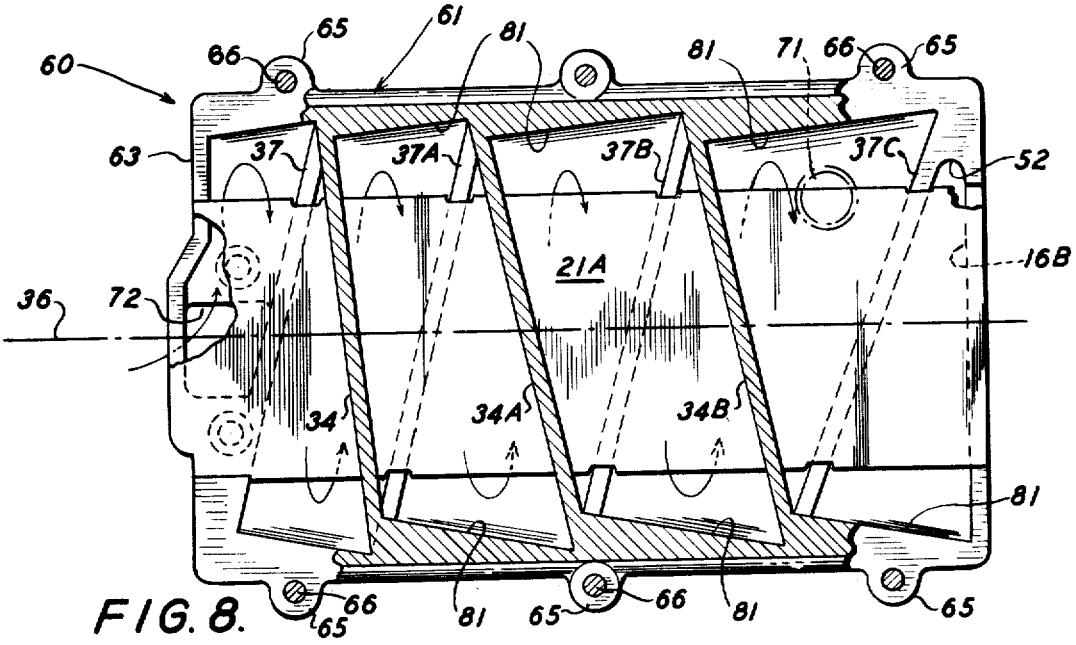
FIG. 8.
FIG. 6.
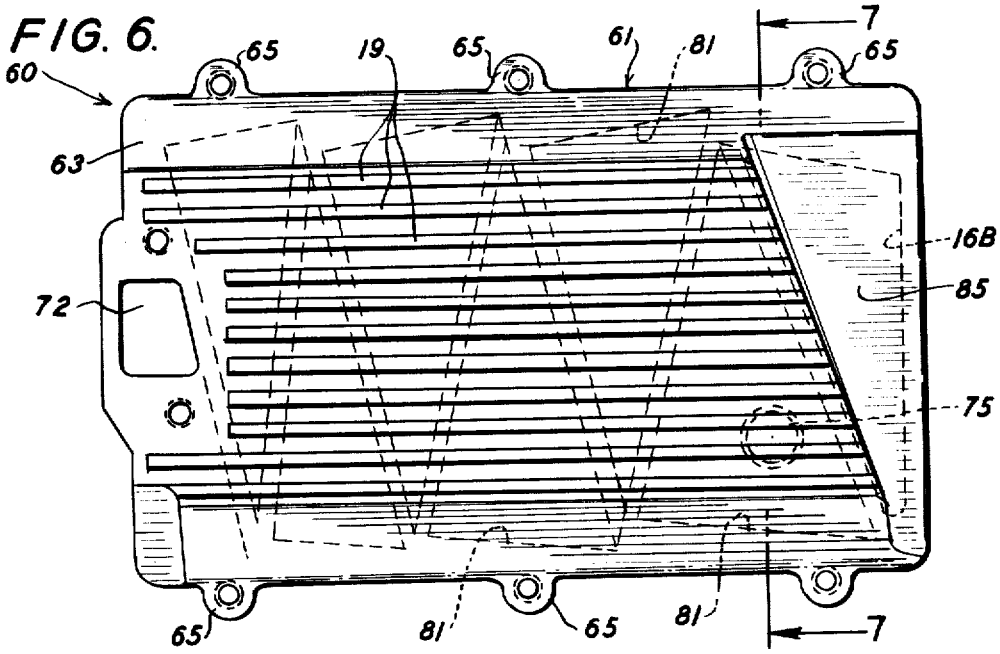

TUNABLE EXPANSION CHAMBER FOR INTERNAL COMBUSTION ENGINES

BACKGROUND OF THE INVENTION

The invention relates to expansion chambers or exhaust mufflers for two-stroke engines but may be utilized with any internal combustion engine having a phase wherein the intake and outlet ports are simultaneously open for a brief interval. Expansion chambers are a preferred means for achieving higher performance from motor vehicles such as motorcycles and replace stock mufflers. A good discussion of expansion chambers is contained in a booklet entitled "Two-Stroke Tuner's Handbook" by Gordon Jennings (1973). As discussed in that booklet on page 51, expansion chambers are an effective device for improving engine performance but have the problems of bulk, noise and inflexibility of mounting position. However, as Mr. Jennings states "unfortunately, . . . there is nothing else in an engineer's bag of tricks that comes anywhere close to matching the boost a two-stroke engine gets from a properly designed expansion chamber exhaust system."

The present invention obviates the bulk and the noise of conventional expansion chambers by in effect folding the chamber in an analogy to a spiral such that its length is compressed. The invention further provides for variable tuning by means of a removable plate which can modify the nominal length of the chamber to "fit" the particular engine porting and the desired optimum RPM of the engine. The length is important because, as is generally known, the distance from the exhaust port at which a sound reflective surface is placed to reflect a positive sound wave to the exhaust port timed to bar the emergence of the fuel charge into the exhaust system before the engine piston closes the exhaust port is critical. This distance is expressed in a formula which is emperical in which port timing in degrees times the velocity of sound in feet per second is divided by the desired revolutions per minute. The invention uses the data derived from this formulation for the basic length of the chamber, compressed in accordance with the invention, and then modifies the effective length in accordance with performance demands by changing the width of the inner divider plate.

SUMMARY OF THE INVENTION

The invention contemplates an expansion chamber or exhaust muffler system for attachment to an engine which has an exhaust port from a cylinder with a piston and a fluid intake port. The invention comprises an outer casing, which may be divided top and bottom, and an inner central divider plate having a longitudinal axis clamped in the outer casing. A first plurality and a second plurality of ribs or diverters extend between the plate surface and the inside wall of the casing each side of the plate. The diverters of one plurality slope with respect to the longitudinal axis oppositely to the diverters of the other plurality. The plate is narrower than the interior of the casing so that an exchange opening is defined between pairs of diverters by the casing and the plate edge. An exhaust input port at one end of the casing connects to the volume between adjacent diverters and the plate and an exhaust outlet port at the opposite end of the casing connects to the volume between adjacent diverters and the inner dividing plate. The diverters, casing and plate define a continuous expansion chamber passage from input port to output port.

In a preferred embodiment of the invention the casing is divided such that the divider plate is removable and replaceable with a second divider plate the transverse dimension of which may be different from the transverse dimension of the first divider plate. The longitudinal space between diverters may increase or otherwise vary from the input port to the outlet port to the effect a reduction of pressure of exhaust gas.

The apparatus of the invention is easily molded in two parts and the divider plate may be stamped from conventional stall plate. The outer casing may be threaded or otherwise adapted at the ports to fit to the engine and other exhaust paraphanelia. The expansion chamber of the invention is approximately one-third the size of a conventional expansion chamber of comparable performance, is lighter in weight and less expensive. Performance is improved over the entire range of RPMs and proper tuning can give optimum performance at the selected RPM range. Noise reduction is substantial.

These and other advantages of the invention are apparent in the following detailed description and drawing.

BRIEF DESCRIPTION OF THE DRAWING

FIG. 5 is an end elevation of an alternate embodiment of the invention;

FIG. 6 is a bottom plan view of embodiment of FIG. 5;

FIG. 7 is a transverse sectional elevation taken along line 7—7 of FIG. 6; and

FIG. 8 is a plan sectional view taken along a line similar to the line 4—4 of FIG. 2.

In the Figures like parts are identified by like reference numerals.

DESCRIPTION OF THE PREFERRED EMBODIMENT

Figure 1:
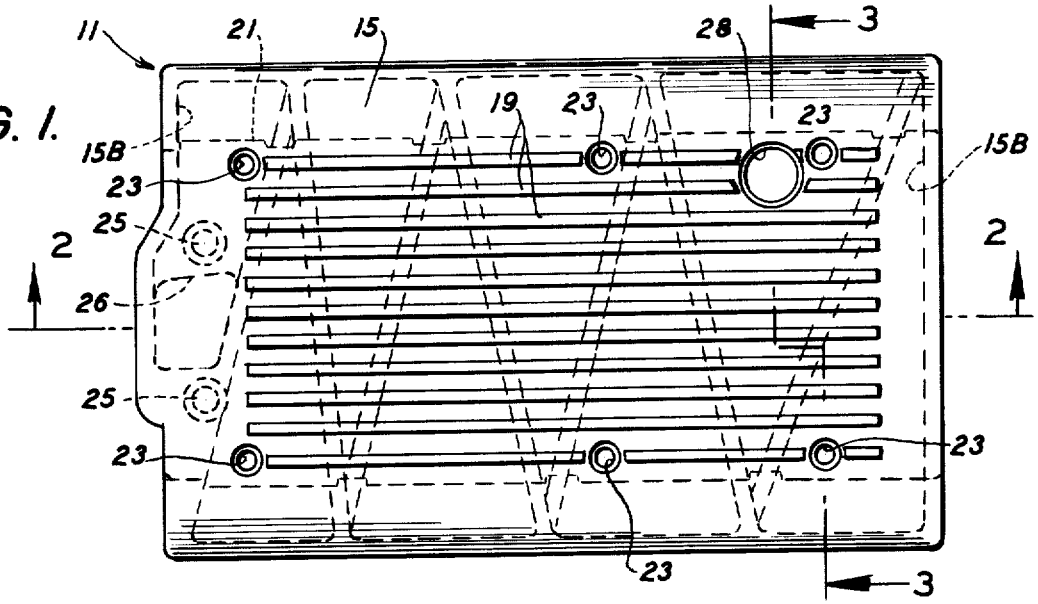
FIG. 1 is a plan view of an expansion chamber in accordance with the invention.

The embodiment of FIGS. 1 through 4 comprises an expansion chamber 11 adapted to fit to an exhaust outlet 12 from an internal combustion engine (not shown) and to a further exhaust outlet pipe 13, which may be a tail pipe or further sound muffling device (not shown). The expansion chamber has an outer casing 14 an upper shell 15 and a lower shell 16, it being understood that the terms "upper" and "lower" refer to the positions of the elements in the drawing and are not necessarily indicative of the positions that the elements have while in use.

Figure 3:
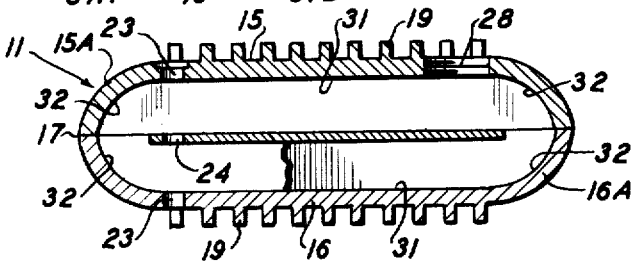
FIG. 3 is a transverse sectional elevation taken along 3—3 of FIG. 1.
Figure 4:
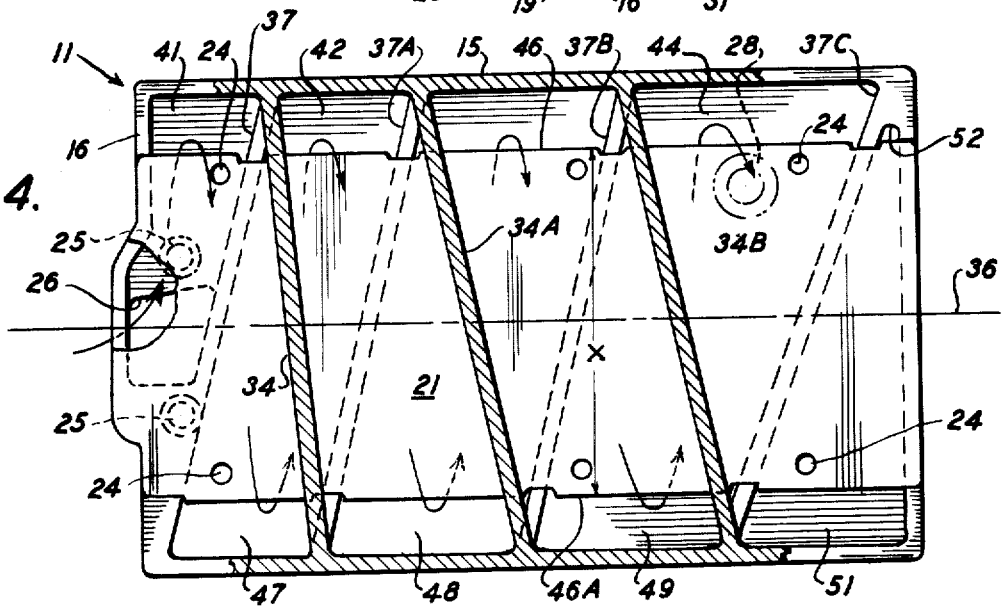
FIG. 4 is a plan view taken along line 4—4 of FIG. 2.

As can be seen from FIG. 3, upper shell 15 has a wall 15A which curves at its transverse extremities downwardly to a part line 17. A plurality of parallel heat dissipating fins 19 extends from wall 15 between the curving portions of the transverse ends.

Lower shell 16 is similarly constructed, having a wall 16A curving at its transverse ends to part line 17 and having a plurality of parallel fins 19 projecting from wall 16A. A thin flat central divider plate 21 extends longitudinally of the outer casing and the longitudinal end walls 15B of upper shell 15 are recessed to accommodate the thickness of plate 21. The two shells and the plate are clamped together by means of bolts (not shown) which extend through apertures 23 in the shells and holes 24 in the central plate. In addition, the countersunk apertures 25 in the lower shell adjacent an exhaust input port 26 provide for attachment between the engine outlet port and the expansion chamber of the invention. A chamber exhaust outlet port 28 in upper shell 15 may be threaded to accommodate an externally threaded tail pipe or other exhaust extension from the expansion chamber.

Figure 2:
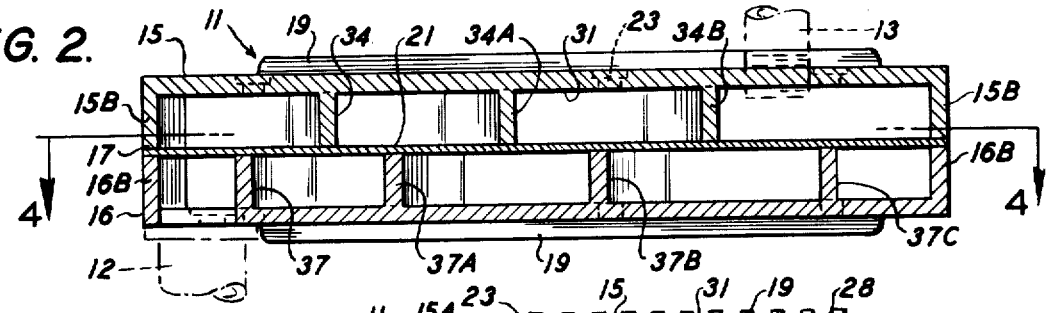
FIG. 2 is a sectional elevation taken along line 2—2 of FIG. 1.

As can be seen from FIGS. 2 and 3, the casing shells each have flat inner walls 31 and arcuate end walls 32. A plurality of diverter ribs 34, 34A, 34B extend from inner wall 31 of shell 15 to central divider plate 21. Diverter ribs 34A, 34B are at an angle to the longitudinal axis 36 of the central divider plate, the axis of the divider plate coinciding with the axis of the outer casing.

Similar diverter ribs 37, 37A, 37B, 37C extend from the inner wall 31 of shell 16 to the center divider plate. Ribs 37-37C are at an opposite angle to the longitudinal axis 36 and to the end walls 15B, 16B of the shells than are ribs 34-34B of shell 15. As can be seen the diverter ribs of each shell are substantially parallel one to another but the distance between adjacent ribs varies longitudinally. Therefore a series of chambers is defined on each side of the central divider plate. Exhaust port 28 communicates with one of the chambers so defined and inlet port 26 communicates with another such chamber. The chambers are interconnected by a plurality of exchange openings such as the openings 41, 42, 43, 44 shown in FIG. 4 between the curving transverse ends of the walls 15A and 16A and a longitudinal edge 46 of the center divider plate. Similar exchange openings 47, 48, 49, 51 are defined between the curving transverse ends of the shells and a longitudinal edge 46A of the central divider plate. The effect is to establish a twisting continuous passage from inlet port 26 to and beyond outlet port 28. In order to achieve smooth gas flow and to have no eddy currents within the exhaust gas pattern central divider plate 21 is recessed in notches of diverter ribs 37-37C.

Referring once again to FIG. 4, it can be seen that exhaust gas flow is through inlet port 26 and thence between plate 21 and shell 16 to exchange opening 41 and thence across the opposite face of plate 21 along diverter rib 34 into exchange opening 47 and thence between diverter ribs 37 and 37A beneath plate 21 to exchange opening 42 and in like manner along the twisting continuous passage to outlet port 28.

The increasing longitudinal distance between the diverter ribs is calculated to reduce gas pressure and thus the density of the exhaust gas within the expansion chamber. This has the effect of lowering the speed of sound which has the advantage of shortening the longitudinal dimension of the expansion chamber in accordance with the formula set forth above. Diverter rib 37C and curving transverse end 32 define a sound reflective chamber in which a rounded apex 52 forms the principal reflecting surface for a positive sound wave to travel backward through the passage just described to the engine exhaust port. As previously set forth the travel length of the sound reflective wave is critical for efficient engine performance. The basic continuous passage length is of course, determined by the molded diverter rib of the outer casing. However, the effective length of the passage may be decreased by decreasing the transverse width of plate 21 in order to maximize the sharpness of tuning for a particular engine in accordance with a particular RPM range at which it is desired to optimize.

The embodiment of FIGS. 5 through 8 is similar in many respects to the embodiment of FIG. 1, an expansion chamber exhaust device 60 having an outer casing 61 comprised of an upper shell 62 and a lower shell 63. The two shells are bolted together about an inner plate 21A which divides the volume defined between the inner walls 31 of the upper and lower shells 62, 63. Each shell has a plurality of apertured ears 65 projecting from the transverse edge of the shell to which bolts 66 are secured to clamp the shells about the central divider plate 21A.

As can be seen from FIGS. 7 and 8, shells 62, 63 have respectively an outlet port 71 and an inlet port 72 adapted to connect with an exhaust tail pipe 74 and engine cylinder exhaust 75 in the manner previously described with respect to the embodiment of FIG. 1. Heat dissipation ribs 19 of both shell 62 and 63 are interrupted to allow for attachment of the engine exhaust system to the expansion chamber of the invention.

In the same fashion as previously set forth with respect to the embodiment of FIG. 1, each shell has a plurality of longitudinally spaced diverter ribs extending transversely of the shells at an angle to the longitudinal axis 36 of the casing. Shell 62 has diverter ribs 34, 34A, 34B. The longitudinal spacing of the ribs with respect to one another may vary. In addition the angle to the longitudinal axis may vary slightly also. Shell 63 has diverter ribs 37, 37A, 37B, 37C extending transversely of the shell at an angle to longitudinal axis 36 and at varying longitudinal distances one from the other. As seen in FIG. 8, the diverter ribs 37-37C of shell 63 lie beneath divider plate 21A and the diverter ribs 34-34B lying above the divider plate, as does the shell 62.

A difference between the embodiment of FIG. 1 and that of FIG. 5 is visible in FIG. 7 where transverse end walls 81 of each shell 62, 63 are seen to be sloping planes rather than curved surfaces as were the end walls 32 of the previously described embodiment. In addition, as can be seen from FIG. 8, each segment of an inner wall 81 between diverter pairs is canted with respect to the longitudinal axis 36 rather than being parallel thereto. The degree of cant is approximately ½ of the complementary angle which the diverter rib adjacent the end makes to the longitudinal axis. Such canted end walls in each of the chambers defined by the diverter ribs and the central divider plate tend to smooth the flow of exhaust gas, lower turbulance and afford less interference with the positive shock wave returning through the exhaust gas stream such that the expansion chamber of the embodiment of FIG. 5 has, under most test conditions, proved to be more efficient than the embodiment of FIG. 1.

It may also be noted that the transverse dimension X (FIG. 4) of embodiment of FIG. 1 is greater than the transverse dimension X' (FIG. 8) of the embodiment of FIG. 5. In a casing of similar dimensions the result of lessening the transverse dimension of the central divider plate 21A is to shorten the path of the positive return sound wave. Thus, with a plurality of plates 21A of varying transverse width, a single expansion chamber can be finely tuned to the requirements of a particular engine exhaust system.

As in the previous embodiment diverter rib 37C and casing end wall 16B coverge in an arcuate wall 52 which acts as a prime reflector point for the positive sound wave reflected back to engine exhaust port. In addition to affording a chamber beyond the point of exit of exhaust gasses the expansion chamber of embodiment of FIG. 5 restricts the volume of the last chambers defined by the shells, ribs and divider plate by a tapering wall portion 85 on shell 63. The wall portion is triangular in plane configuration, as shown in FIG. 6, and reduces the volume of the chamber defined by diverter rib 37C and end casing wall 16B by sloping transversely toward the plate 21A. A similar but smaller volume reduction of the ported chamber to which the exhaust outlet port 71 connects is achieved by a small reduction of the depth dimension between divider plate and wall 31 of the shell 62 in a wall portion 31C which reduces the volume defined by diverter rib 34B and casing end wall 16B.

The net result of the shaping of the interior of the casing is to approximate the oppositely sloping compound cone shape of a conventional expansion chamber the advantages of which are now afforded in the inventive device in a more compact and light weight configuration.

The operation of the embodiment of FIG. 5 is similar to that of FIG. 1 with exhaust gas flow and sound wave reflection being along similar paths.

Each of the embodiments has the advantage of being easily mass produced of available materials by conventional techniques. Each embodiment offers the advantages of fine tuning through interchanging of central divider plates of varying transverse width and both embodiments are smaller and lighter than comparable conventional expansion chambers which lack the versatility of the present invention.

It is obvious that the number of diverter ribs and the spacing thereof may be modified in order to achieve a continuous passage commensurate with the design parameters for the particular exhaust system. The embodiments shown therefore are to be considered exemplary only of the invention. It is realized that modifications within the scope of the invention other than those shown will occur to those skilled in this particular art. It is therefore desired that the scope of the invention be measured by the appended claims rather than by the illustrative embodiments disclosed herein.

I claim:

1. An expansion chamber for attachment to an internal combustion engine having an exhaust port from a cylinder with a piston and a fuel intake port, the combination comprising an outer casing, an inner central divider plate having a longitudinal axis, a first plurality of longitudinal spaced diverters extending between plate and casing on one side of the plate, a second plurality of diverters extending between plate and casing on the other side of the plate, the diverters of one plurality sloping with respect to the longitudinal axis oppositely to the diverters of the other plurality, said plate being narrower than the interior of said casing such that an exchange opening is defined between pairs of diverters between casing and plate edge, an exhaust input port at one end of said casing connecting to the volume between adjacent diverters and said plate, and an exhaust outlet port in said casing connecting to the volume between adjacent diverters and said plate at a casing end remote from said input port, said diverters, casing and plate defining a continuous passage from input port to outlet port.

2. An expansion chamber in accordance with claim 1 wherein the longitudinal spacing between adjacent diverters of a plurality increases from input port to outlet port.

3. An expansion chamber in accordance with claim 1 wherein said divider plate is removable.

4. An expansion chamber in accordance with claim 3 further comprising a plurality of removable central divider plates of varying dimension transverse to the longitudinal axis.

5. An expansion chamber in accordance with claim 1 wherein said outer casing comprises a first shell, a second shell, each of said shells having a plurality of longitudinally spaced diverters, walls in said shell and said diverters defining a recess for said divider plate, and means for clamping said shells about said divider plate.

6. An expansion chamber in accordance with claim 1 further comprising a casing reflective surface adjacent each exchange opening, at least a part of said reflective surface having an angle of the adjacent diverters to the longitudinal axis.

7. An expansion chamber in accordance with claim 1 wherein said outer casing of inner walls diminish in distance from said divider plate between said diverters with which said outlet port communicates.

8. A tuner muffler for attachment to an engine having an exhaust port from a cylinder with a piston and a fuel intake port, the combination comprising an outer casing, an inner central divider plate having a longitudinal axis, a first plurality of diverters extending between plate and casing on one side of the plate, a second plurality of diverters extending between plate and casing on the other side of the plate, the diverters of one plurality sloping with respect to the longitudinal axis oppositely to the diverters of the other plurality, said plate being narrower than the interior of said casing such that an exchange opening is defined between pairs of diverters between casing and plate edge to define with said casing and plate and diverters a continuous twisting passage, an exhaust input port at one end of said casing connecting to the volume between adjacent diverters and said plate, an exhaust outlet port in said casing connecting to the volume between adjacent diverters and said plate at a casing end remote from said input port and a sound reflective wall in the casing at an end thereof remote from said input port.

9. An expansion chamber in accordance with claim 8 wherein the longitudinal spacing between adjacent diverters of a plurality increases from input port to outlet port.

10. An expansion chamber in accordance with claim 8 wherein said divider plate is removable.

11. An expansion chamber in accordance with claim 10 further comprising a plurality of removable central divider plates of varying dimension transverse to the longitudinal axis.

12. An expansion chamber in accordance with claim 8 wherein said outer casing comprises a first shell, a second shell, each of said shells having a plurality of longitudinally spaced diverters, walls in said shell and said diverters defining a recess for said divider plate, and means for clamping said shells about said divider plate.

13. An expansion chamber in accordance with claim 8 further comprising a casing reflective surface having an angle to the longitudinal axis less than the complement of the angle of the adjacent diverters to the longitudinal axis.

* * * * *